US008707749B2

(12) United States Patent
Lee et al.

(10) Patent No.: US 8,707,749 B2
(45) Date of Patent: Apr. 29, 2014

(54) ROLL FORMING SYSTEM AND ROLL FORMING METHOD

(75) Inventors: Mun-Yong Lee, Pusan (KR); Dong-Kyu Kim, Pusan (KR)

(73) Assignee: Sungwoo Hitech Co., Ltd., Pusan (KR)

( * ) Notice: Subject to any disclaimer, the term of this patent is extended or adjusted under 35 U.S.C. 154(b) by 578 days.

(21) Appl. No.: 12/969,704

(22) Filed: Dec. 16, 2010

(65) Prior Publication Data

US 2012/0125065 A1 May 24, 2012

(30) Foreign Application Priority Data

Nov. 24, 2010 (KR) ..... 10-2010-0117724

(51) Int. Cl.
*B21F 11/00* (2006.01)
*B21D 5/14* (2006.01)

(52) U.S. Cl.
USPC ..... 72/130; 72/132; 72/168; 72/169

(58) Field of Classification Search
USPC ..... 72/129, 130, 132, 166, 168, 169; 83/404, 405, 412; 29/897.2
See application file for complete search history.

(56) References Cited

U.S. PATENT DOCUMENTS

| | | | | |
|---|---|---|---|---|
| 5,092,512 | A * | 3/1992 | Sturrus et al. | 228/146 |
| 5,305,625 | A * | 4/1994 | Heinz | 72/132 |
| 5,454,504 | A * | 10/1995 | Sturrus | 228/17 |
| 5,934,544 | A * | 8/1999 | Lee et al. | 228/146 |
| 6,386,011 | B1 * | 5/2002 | Levy | 72/129 |
| 6,484,386 | B2 | 11/2002 | Tuin | |
| 6,813,920 | B2 * | 11/2004 | Yoshida et al. | 72/166 |
| 7,197,824 | B1 | 4/2007 | Graber | |
| 7,503,116 | B2 * | 3/2009 | Machrowicz et al. | 29/897 |
| 7,882,718 | B2 * | 2/2011 | Lyons et al. | 72/168 |
| 8,151,614 | B2 * | 4/2012 | Heinz et al. | 72/132 |
| 8,333,096 | B2 * | 12/2012 | Heinz et al. | 72/168 |
| 8,336,355 | B2 * | 12/2012 | Koo et al. | 72/168 |
| 2003/0230129 | A1 | 12/2003 | Yoshida | |
| 2009/0165520 | A1 | 7/2009 | Koo | |

FOREIGN PATENT DOCUMENTS

| | | |
|---|---|---|
| CN | 101412186 | 4/2009 |
| JP | 09-234521 | 9/1997 |
| KR | 10-0206022 | 4/1999 |
| KR | 10-2008-0101535 | 11/2008 |
| KR | 10-2010-0035452 | 4/2010 |
| KR | 10-2010-0078723 | 7/2010 |

OTHER PUBLICATIONS

Chinese Patent Office, Search Report dated Nov. 15, 2013, which was attached to the Office Action dated Nov. 28, 2013 of the corresponding Chinese Patent Application No. 201010591710.8.

* cited by examiner

*Primary Examiner* — Edward Tolan
(74) *Attorney, Agent, or Firm* — Lexyoume IP Meister, PLLC

(57) ABSTRACT

A roll forming system and a roll forming method are disclosed. The roll forming system according to an exemplary embodiment of the present invention includes a bending unit provided with synchronizing means moving a synchronizing table in keeping pace with a forming speed of a shaped beam along a process line, clamping means clamping both sides of the shaped beam, position conversion means converting a position of the shaped beam between a cutting position and a bending position, cutting means cutting one side of the shaped beam by a cutting wheel, and a bending means stretch-bending the shaped beam to have a predetermined curvature.

11 Claims, 14 Drawing Sheets

ROLL FORMING SYSTEM AND ROLL FORMING METHOD

CROSS-REFERENCE TO RELATED APPLICATION

This application claims priority to and the benefit of Korean Patent Application No. 10-2010-0117724 filed in the Korean Intellectual Property Office on Nov. 24, 2010, the entire contents of which are incorporated herein by reference.

BACKGROUND OF THE INVENTION (a) Field of the Invention

The present invention relates to a roll forming system and a roll forming method. More particularly, the present invention relates to a roll forming system and a roll forming method in which cutting and stretch bending of a shaped beam is simultaneously performed in keeping pace with a forming speed of a roll forming after the roll forming.

(b) Description of the Related Art

Generally, a roll forming method is a method in which a coil is uncoiled and the coil is bent to various shapes by passing through a roll forming unit including a plurality of roll formers respectively provided with an upper forming roll and a lower forming roll. The roll forming method is used for manufacturing beams of linear type (particularly, a bumper beam for a vehicle) which is bent to the various shapes.

FIG. 1 is a schematic diagram of a roll forming system according to a conventional art which performs a roll forming method.

As shown in FIG. 1, the roll forming system according to the conventional art includes an uncoiler 201 at a front portion of a process line, and the uncoiler 201 performs an uncoil step S110 at which a coil 200 is uncoiled. A straightener 203 is provided at the rear of the uncoiler 201 and performs a straightening step S120 at which the coil uncoiled from the uncoiler 201 is straightened to a panel 210 of plate shape.

In addition, a brake press 205 is disposed at the rear of the straightener 203 and performs a piercing step S130 at which a plurality of holes for assembling is formed at the panel 210 supplied from the straightener 203.

In addition, a roll forming unit 207 including at least seven roll formers R1-R7 is disposed at the rear of the brake press 205 and performs a roll forming step S140 at which the panel 210 passing through the uncoiler 201, the straightener 203, and the brake press 205 is sequentially bent such that a shaped beam 260 is formed.

A welding unit 209 such as a roll spot welding tool is disposed at the rear of the roll forming unit 207 and performs a welding step S150 at which each welding position of the shaped beam 220 is welded.

In addition, a rounder bender 211 is disposed at the rear of the welding unit 209 and performs a bending step S160 at which the shaped beam 230 delivered from the welding step S150 is formed to have a predetermined curvature.

A cutting press 213 is disposed at the rear of the rounder bender 211 and performs a cutting step S170 at which the shaped beam 240 is cut in a predetermined size.

A finished shaped beam 250, as shown in FIG. 2, is manufactured by the roll forming system.

Recently, a thickness of the shaped beam 250 having a closed section is being increased thicker than 50 mm in order to enhance collision strength.

By the conventional roll forming system, the shaped beam 250 of the closed section having a thickness thinner than 50 mm can be manufactured. In a case that the shaped beam 250 of the closed section having a thickness thicker than 50 mm, deformation at an inner surface of a curvature of the shaped beam 250 is large if the shaped beam 250 is manufactured by the conventional roll forming system. Therefore, buckling may occur at the inner surface of the shaped beam if the bending step S160 is performed by the rounder bender 211.

Therefore, in order to form the shaped beam of closed section having the thickness thicker than 50 mm to have the predetermined curvature, a stretch bending method at which both sides of the shaped beam are pushed to one direction should be used.

However, in order to apply the stretch bending method to the conventional roll forming system, a process speed of the stretch bending should be synchronized with a forming speed of the roll forming of the shaped beam. In addition, a cutting process of the shaped beam should be performed prior to stretch bending.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a roll forming system and a roll forming method having advantages that cutting and stretch bending of a shaped beam is simultaneously performed in keeping pace with a forming speed of a roll forming after the roll forming.

A roll forming system according to an exemplary embodiment of the present invention may include: an uncoiler disposed at a front portion of a process line and uncoiling a coil; a straightener disposed at the rear of the uncoiler and straightening the coil uncoiled by the uncoiler to a panel of plate shape; a brake press disposed at the rear of the straightener and forming a plurality of holes for assembling at the panel delivered from the straightener; a roll forming unit disposed at the rear of the brake press and sequentially bending the panel delivered from the brake press so as to roll-form a shaped beam of a predetermined shape; and a welding unit disposed at the rear of the roll forming unit and welding each welding position of the shaped beam which is roll-formed, wherein the roll forming system further comprises a bending unit disposed at the rear of the welding unit, cutting one side of the shaped beam by a cutting wheel, changing a position of the shaped beam, and pushing the shaped beam to a stretch bending tool so as to bend the shaped beam to have a predetermined curvature in keeping pace with a forming speed of a roll forming in a state that both sides of the shaped beam delivered from the welding unit are clamped.

The welding unit may include: front and rear guide rollers mounted apart from each other at the rear of the roll forming unit and guiding a movement of the shaped beam; and a laser scanner disposed between and above the front and rear guide rollers and irradiating a laser beam output from a laser oscillator to the welding position of the shaped beam so as to perform a welding process.

The bending unit may include: synchronizing means disposed at the rear of the welding unit and provided with a synchronizing table which can slide along the process line by an operation of a synchronizing motor; clamping means mounted on front and rear portions of the synchronizing table, rotating along a width direction of the synchronizing table, and clamping the both sides of the roll-formed shaped beam; position conversion means pivotably mounted on the synchronizing table between the both clamping means, connected to the both clamping means, and configured to convert a position of the shaped beam clamped by the both clamping means between a cutting position and a bending position; cutting means mounted on the synchronizing table through a cutting frame, moving with the synchronizing table in keeping pace with the forming speed of the shaped beam, and cutting the one side of the shaped beam by moving the cutting wheel forward or backward by a forward/reverse motor; and bending means disposed on the synchronizing table and bending the shaped beam to have the predetermined curvature by a force of the clamping means in a state that the position of the shaped beam clamped by the clamping means is changed to the bending position by the position conversion means.

The synchronizing means may include: a rail plate provided with guide rails mounted on both side portions thereof along the process line; a synchronizing table slidably mounted at each guide rail through a rail block and provided with a screw block mounted on a lower surface thereof; and a synchronizing motor provided with a screw shaft mounted on the rail plate along the process line, threaded to the screw block, and configured to move the synchronizing table along the process line by rotating the screw shaft.

The synchronizing motor may be a screw motor which can control a rotation speed and a rotating direction.

The clamping means may include: hinge blocks mounted on front and rear portions of the synchronizing table; a bending cylinder mounted on an upper end of each hinge block and rotating along a width direction of a synchronizing table; a locator mounted at an operating rod of each bending cylinder and provided with a receiving surface of the shaped beam formed at an upper end thereof; clamping cylinders fixedly mounted respectively at flange portions formed at both sides of the locator; and a clamper disposed corresponding to the receiving surface of the locator and provided with both sides connected to operating rods of the clamping cylinders.

The bending cylinder may be a hydraulic pressure cylinder operated by hydraulic pressure.

The position conversion means may include: a connecting rod connecting the both clamping means; and a position conversion cylinder pivotably connected to a mounting hole formed on the synchronizing table, connected to the connecting rod through a rotation ring, and configured to push or pull the connecting rod.

The position conversion cylinder may be a hydraulic pressure cylinder operated by hydraulic pressure.

The cutting means may include: a cutting frame mounted on the synchronizing table and provided with forward/reverse rails formed on front and rear portions of an upper surface along a width direction thereof; a forward/reverse plate slidably mounted on the forward/reverse rails through sliders and provided with a screw block formed on a lower surface thereof; the forward/reverse motor disposed on the cutting frame along a width direction thereof, provided with a screw shaft threaded to the screw block, and moving the forward/reverse plate by rotating the screw shaft; and a wheel motor mounted to the forward/reverse plate through a mounting bracket and rotating the cutting wheel.

The forward/reverse motor may be a screw motor which can control a rotation speed and a rotating direction.

The bending means may include: a tool holder fixed on the synchronizing table; and the stretch bending tool mounted at the tool holder and provided with a forming surface having a predetermined curvature formed at one surface thereof.

A roll forming method according to another exemplary embodiment of the present invention may include: an uncoil step at which a coil is uncoiled by an uncoiler at a front portion of a process line; a straightening step at which the coil uncoiled from the uncoiler is straightened to a panel of plate shape by a straightener; a piercing step at which a plurality of holes for assembling a shaped beam is formed at the panel delivered from the straightener by a brake press; a roll forming step at which the panel delivered from the brake press is sequentially bent to form a shaped beam of a predetermined shape by a roll forming unit; and a welding step at which a welding position of the shaped beam delivered from the roll forming unit is welded by a welding unit, wherein the roll forming method further comprises a cutting and bending step at which both sides of the shaped beam moving along the process line are clamped at the rear of the welding unit, cutting one side of the shaped beam in keeping pace with a forming speed, changing a position of the shaped beam corresponding to a stretch bending tool, and pushing the shaped beam to a forming surface of the stretch bending tool so as to have a predetermined curvature.

A laser beam output from a laser oscillator may be irradiated to a welding position of the shaped beam at the welding step.

<Description of symbols>

| | |
|---|---|
| 1: uncoiler | 2: straightener |
| 3: brake press | 4: roll forming unit |
| 5: welding unit | 6: bending unit |
| 9: base | 10: coil |
| 20: panel | 30, 40: shaped beam |
| 110: synchronizing means | 120: clamping means |
| 130: position conversion means | 140: cutting means |
| 150: bending means | 111: synchronizing motor |
| 112: synchronizing table | 113: rail plate |
| 114: guide rail | 115: rail block |
| 116: screw block | 117: screw shaft |
| 121: hinge block | 122: bending cylinder |
| 123: locator | 124: clamping cylinder |
| 125: flange portion | 126: clamper |
| 131: connecting rod | 132: position conversion cylinder |
| 133: operating rod | 134: rotation ring |
| 141: cutting frame | 142: forward/reverse rail |
| 143: slider | 144: forward/reverse plate |
| 145: screw block | 146: screw shaft |

-continued

| <Description of symbols> | |
|---|---|
| 147: forward/reverse motor | 148: mounting bracket |
| 149: wheel motor | CW: cutting wheel |
| 151: stretch bending tool | 153: tool holder |

DETAILED DESCRIPTION OF THE EMBODIMENTS

Hereinafter, an exemplary embodiment of the present invention will be described in detail with reference to the accompanying drawings.

Figure 1:
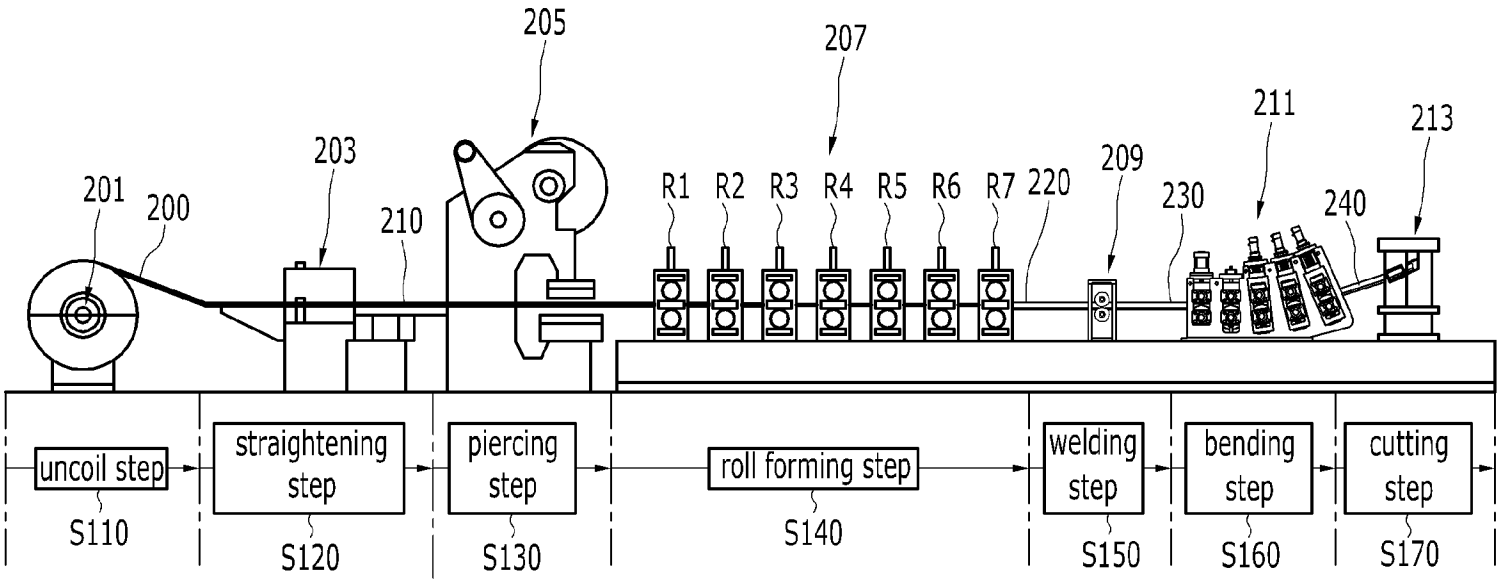
FIG. 1 is a schematic diagram of a conventional roll forming system.
Figure 2:
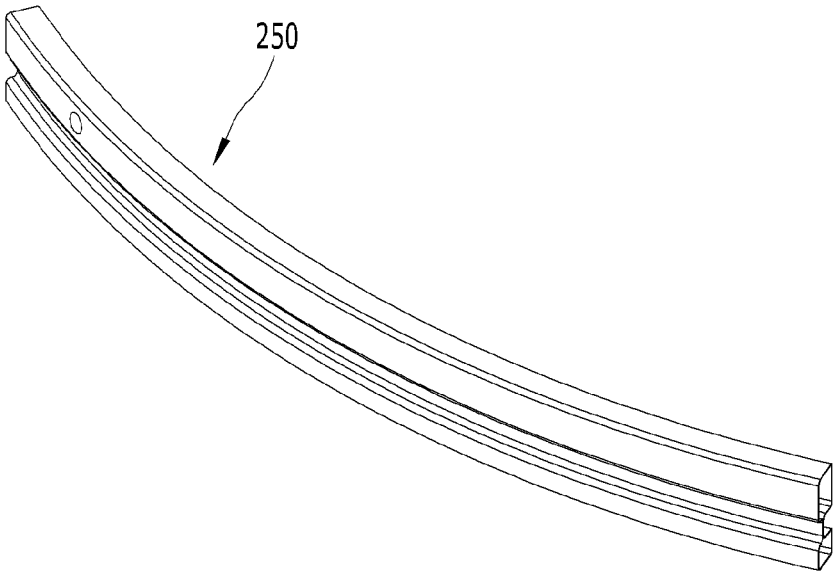
FIG. 2 is a perspective view of a bumper beam for a vehicle manufactured by a conventional roll forming system.
Figure 3:
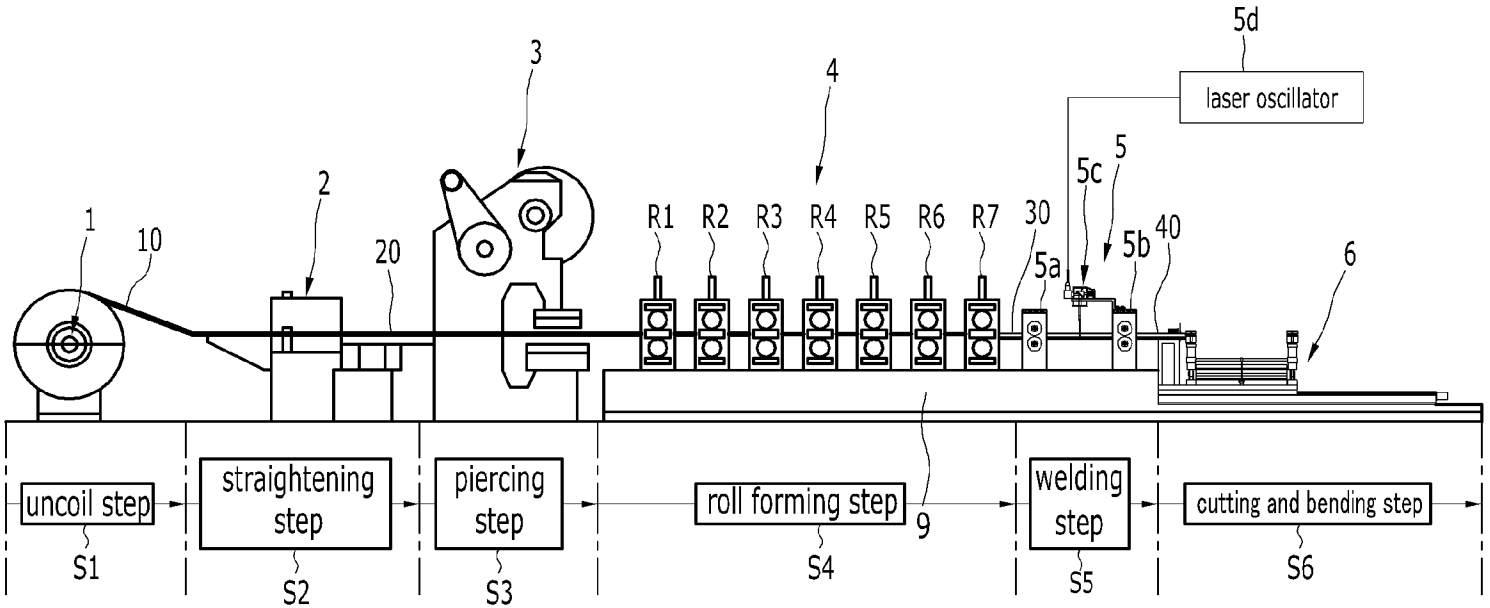
FIG. 3 is a schematic diagram of a roll forming system according to an exemplary embodiment of the present invention.

FIG. 3 is a schematic diagram of a roll forming system according to an exemplary embodiment of the present invention.

A roll forming system according to an exemplary embodiment of the present invention, as shown in FIG. 3, includes an uncoiler 1 disposed at the front of a process line and uncoiling a coil 10.

A straightener 2 is disposed at the rear of the uncoiler 1 and straightens the coil 10 uncoiled from the uncoiler 1 to a panel 20 of plate shape.

In addition, a brake press 3 is disposed at the rear of the straightener 2 and forms a plurality of holes for assembling a shaped beam at the panel 20 delivered from the straightener 2.

A roll forming unit 4 is disposed at the rear of the brake press 3. The roll forming unit 4 sequentially bends the panel 20 passing through the straightener 2 and the brake press 3 so as to roll-form the shaped beam 30 having a closed section.

The roll forming unit 4 includes at least seven roll formers R1-R7 disposed in series.

In addition, a welding unit 5 is disposed at the rear of the roll forming unit 4 and performs laser welding at a welding position of the shaped beam 30.

The welding unit 5 includes front and rear guide rollers 5*a* and 5*b* disposed apart from each other on a base 9 mounted at the rear of the roll forming unit 4 in the process line. The front and rear guide rollers 5*a* and 5*b* guide a movement of the shaped beam 30.

In addition, a laser scanner 5*c* is disposed between and above the front and rear guide rollers 5*a* and 5*b*. The laser scanner 5*c* irradiates a laser beam output from a laser oscillator 5*d* to the welding position of the shaped beam 30, and thereby performs a welding process.

In addition, the roll forming system according to an exemplary embodiment of the present invention is provided with a bending unit 6 disposed at the rear of the welding unit 5. The bending unit 6 clamps both sides of the shaped beam 40 delivered from the welding unit 5 and operates in keeping pace with a forming speed of a roll forming. The bending unit 6 cuts one side of the shaped beam 40 by a cutting wheel CW, and then changes a position of the shaped beam 40. In addition the bending unit 6 pushes the shaped beam 40 to have a predetermined curvature to the stretch bending tool 151.

Hereinafter, the bending unit 6 will be described in detail with reference to FIG. 4 and FIG. 5.

Figure 4:
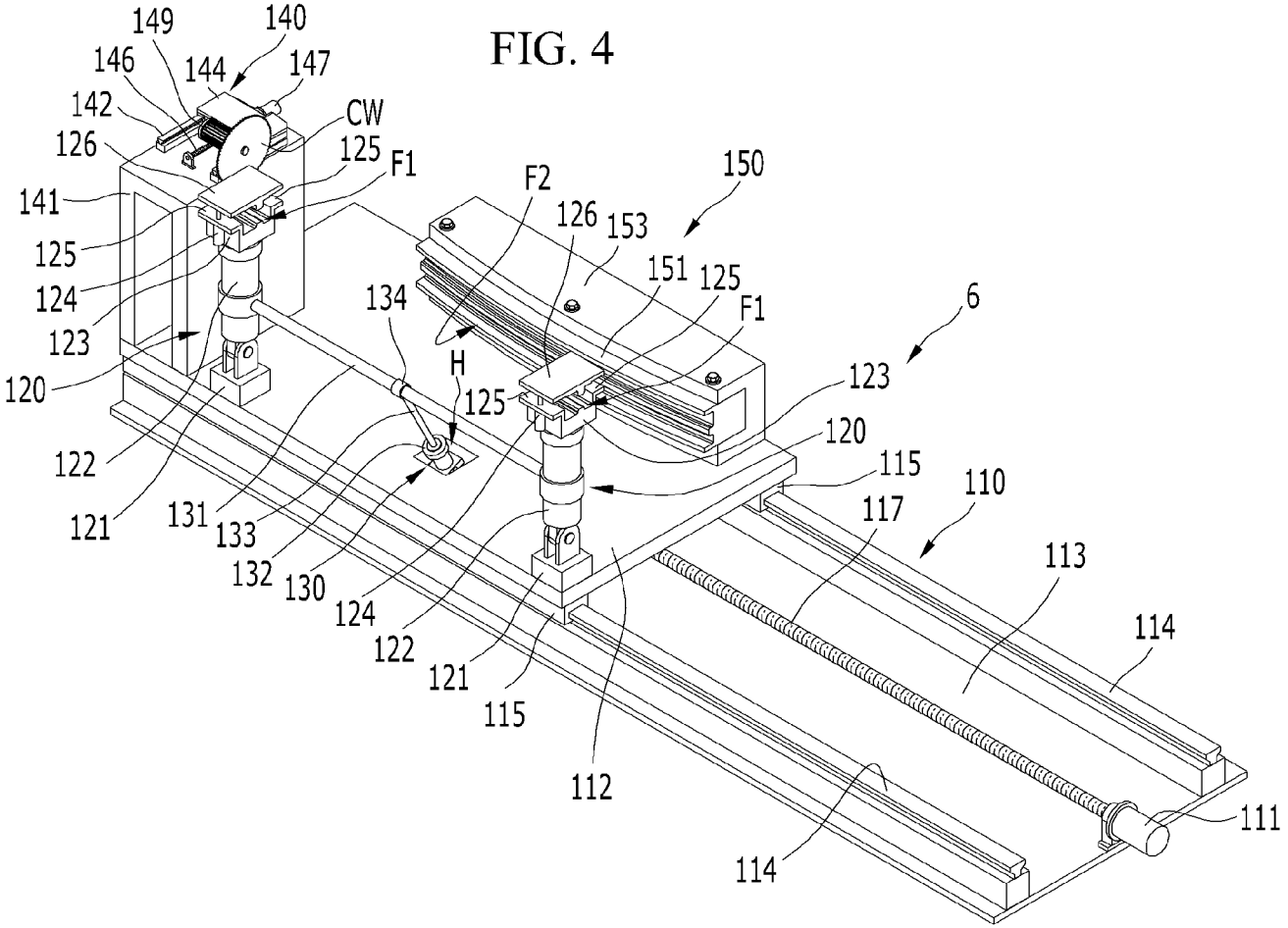
FIG. 4 is a front perspective view of a bending unit used in a roll forming system according to an exemplary embodiment of the present invention.
Figure 5:
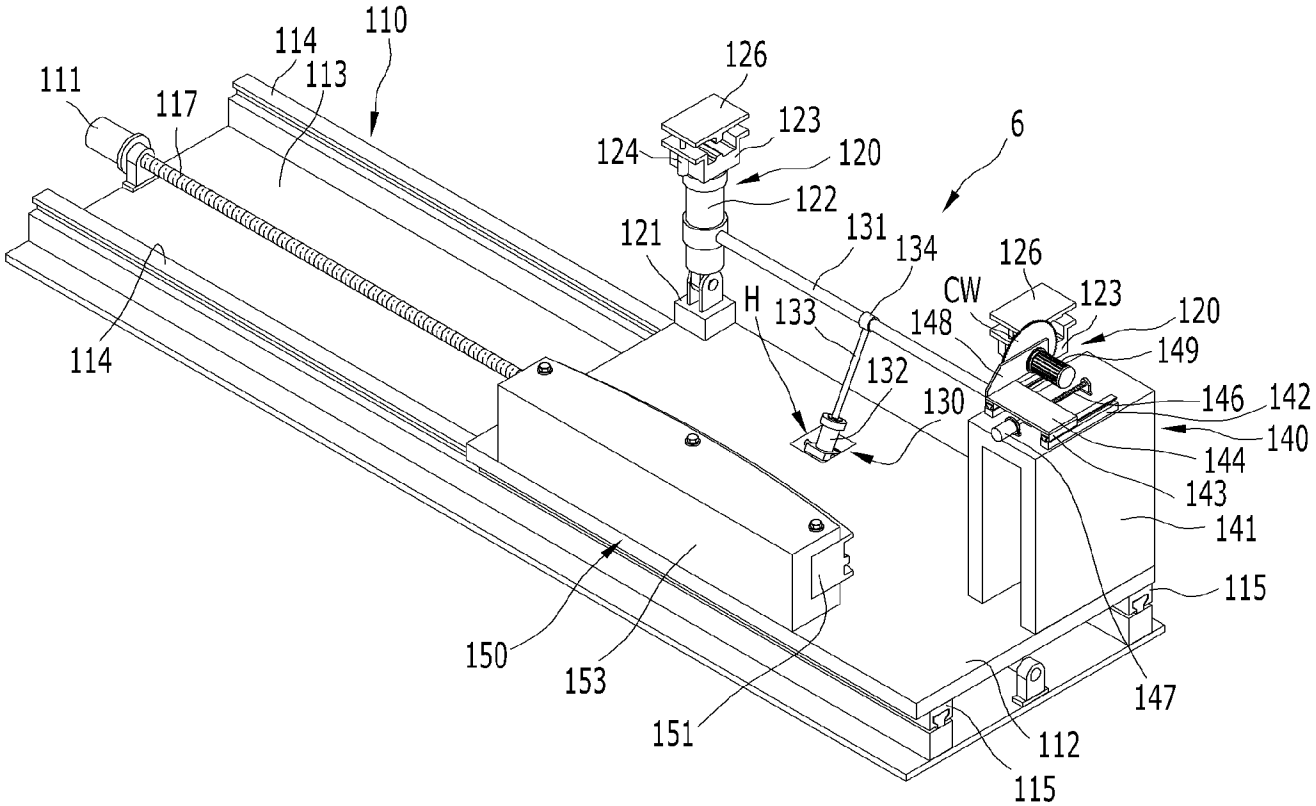
FIG. 5 is a rear perspective view of a bending unit used in a roll forming system according to an exemplary embodiment of the present invention.

FIG. 4 is a front perspective view of a bending unit used in a roll forming system according to an exemplary embodiment of the present invention, and FIG. 5 is a rear perspective view of a bending unit used in a roll forming system according to an exemplary embodiment of the present invention.

Referring to FIG. 4 and FIG. 5, the bending unit 6 includes synchronizing means 110, clamping means 120, position conversion means 130, cutting means 140, and bending means 150.

The synchronizing means 110 is disposed on the base 9 at the rear of the welding unit 5 in the process line, and slides a synchronizing table 112 along the process line by a synchronizing motor 111.

The synchronizing means 110 will be described in detail referring to FIG. 6.

Figure 6:
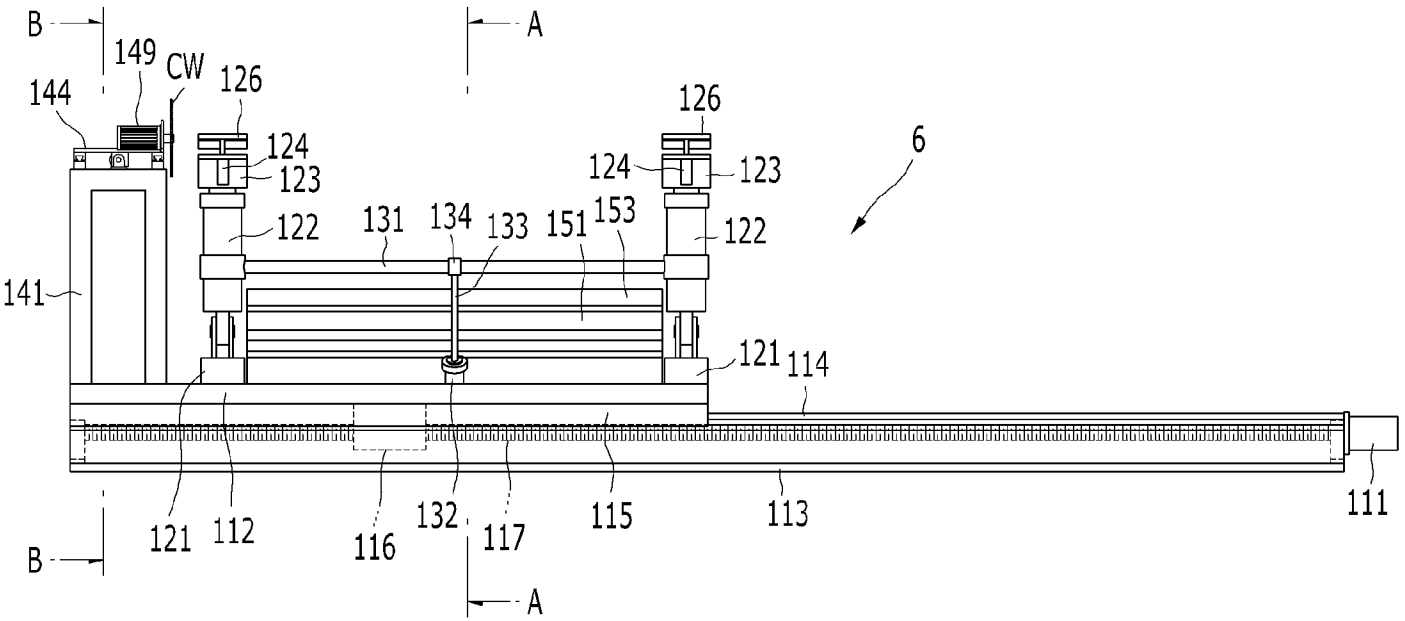
FIG. 6 is a front view of a bending unit used in a roll forming system according to an exemplary embodiment of the present invention.

FIG. 6 is a front view of a bending unit used in a roll forming system according to an exemplary embodiment of the present invention.

Referring to FIG. 6, the synchronizing means 110 includes a rail plate 113. The rail plate 113 is mounted on the base 9, and guide rails 114 are mounted on both side portions of the rail plate 113 along the process line.

The synchronizing table 112 is slidably mounted on each guide rail 114 on the rail plate 113 through a rail block 115.

In addition, a screw block 116 is integrally mounted on a middle portion of a lower surface of the synchronizing table 112.

A screw shaft 117 is rotatably disposed between both guide rails 114 on the rail plate 113 along the process line.

At this time, the screw shaft 117 is threaded to the screw block 116.

In addition, the synchronizing motor 111 is mounted at a rear portion of the rail plate 113.

The synchronizing motor 111 rotates the screw shaft 117. At this time, a screw motor which can control a rotation speed and a rotating direction of the screw shaft 117 may be used as the synchronizing motor 111.

In addition, the clamping means 120 is disposed at a front portion of the synchronizing table 112 and clamps both sides of the shaped beam 40 which is roll-formed.

The clamping means 120 will be described in detail referring to FIG. 7.

Figure 7:
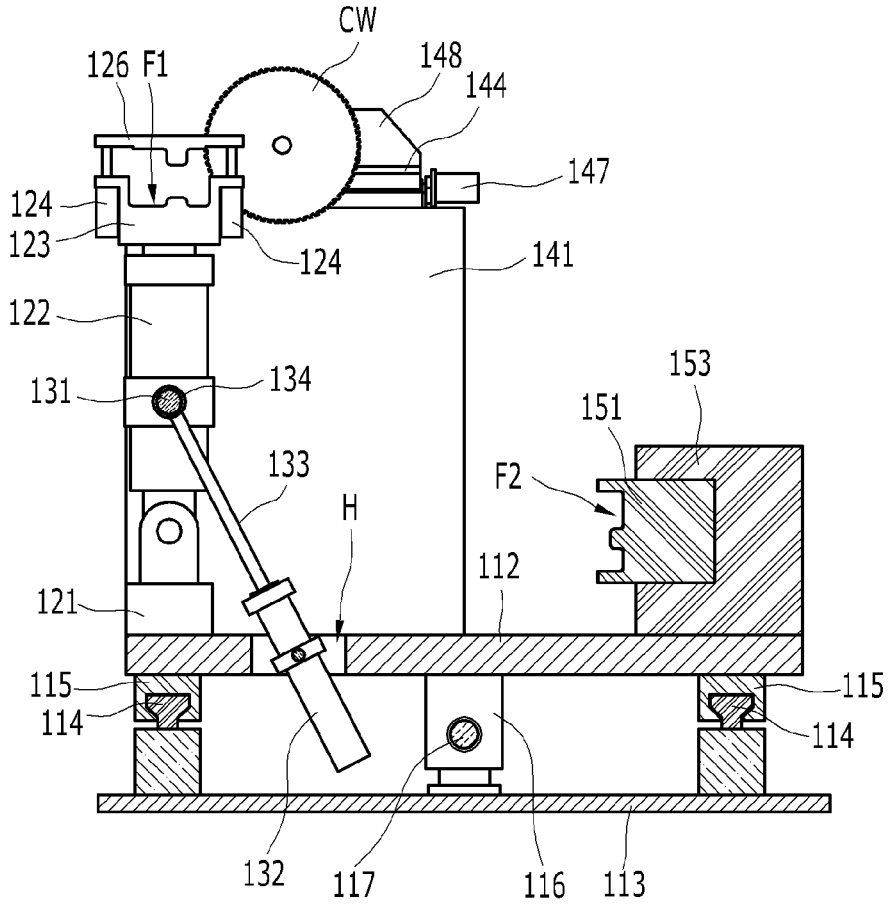
FIG. 7 is a cross-sectional view taken along the line A-A in FIG. 6.

FIG. 7 is a cross-sectional view taken along the line A-A in FIG. 6.

Referring to FIG. 7, the clamping means 120 includes hinge blocks 121 disposed respectively at the front and rear portions of the synchronizing table 112.

A bending cylinder 122 is disposed on each hinge block 121. The bending cylinder 122 can rotate along a width direction of the synchronizing table 112.

Herein, the bending cylinder 122 may be a hydraulic pressure cylinder operated by hydraulic pressure, but is not limited thereto.

A locator 123 is mounted on an upper end of an operating rod of each bending cylinder 122. A receiving surface F1 of the shaped beam 40 is formed on an upper surface of the locator 123.

Flange portions 125 are formed at both sides of the locator 123, and a clamping cylinder 124 is fixedly mounted at each flange portion 125.

In addition, a clamper 126 is disposed corresponding to the receiving surface F1 of the locator 123, and both sides of the clamper 126 are connected to operating rods of the clamping cylinders 124.

That is, the clamper 126 together with the locator 126 clamps the both sides of the shaped beam 40 by an operation of each clamping cylinder 124.

In addition, the position conversion means 130 is mounted on the synchronizing table 112 between the both clamping means 120.

The position conversion means 130 will be described in detail referring to FIG. 7.

Referring to FIG. 7, the position conversion means 130 is connected to the both bending cylinders 122 through a connecting rod 131.

In addition, a mounting hole H is formed on the synchronizing table 112 and the position conversion cylinder 132 is pivotably connected in the mounting hole H.

A front end of an operating rod 133 of the position conversion cylinder 132 is connected to the connecting rod 131 through a rotation ring 134.

Herein, the position conversion cylinder 132 may be a hydraulic pressure cylinder operated by hydraulic pressure, but is not limited thereto.

That is, the position conversion cylinder 132 is connected to both bending cylinders 122 of both clamping means 120 through the connecting rod 131. If the operating rod 133 of the position conversion cylinder 132 moves forward or backward, a position of the shaped beam 40 clamped by the clampers 126 and the locators 123 of both clamping means 120 is changed to a cutting position or a bending position.

In addition, the cutting means 140 is mounted at one side portion of the front portion of the synchronizing table 112 through a cutting frame 141.

The cutting means 140 will be described in detail referring to FIG. 8.

Figure 8:
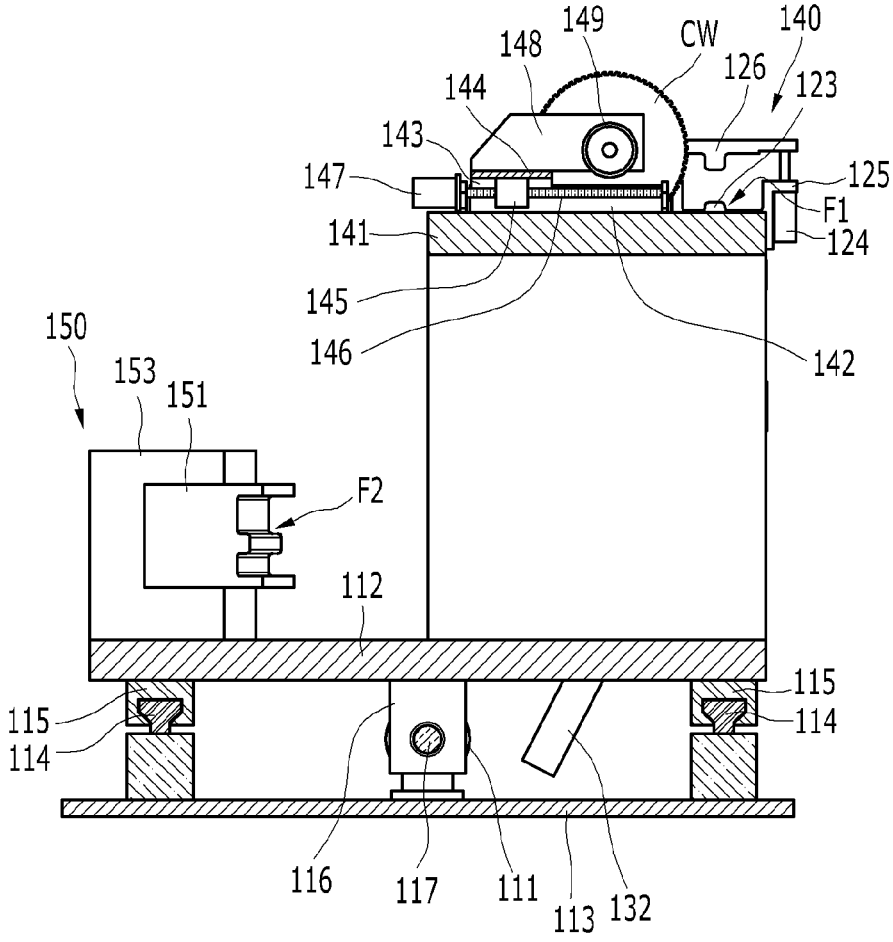
FIG. 8 is a cross-sectional view taken along the line B-B in FIG. 6.

FIG. 8 is a cross-sectional view taken along the line B-B in FIG. 6.

Referring to FIG. 8, the cutting frame 141 is mounted at the one side of the front portion of the synchronizing table 112, and forward/reverse rails 142 are mounted at a front portion and rear portion of the cutting frame 141 along a width direction thereof.

A forward/reverse plate 144 is slidably mounted at each forward/reverse rail 142 on the cutting frame 141 through a slider 143.

In addition, a screw block 145 is integrally mounted at a lower surface of the forward/reverse plate 144.

In addition, a screw shaft 146 is disposed on the cutting frame 141 between the forward/reverse rails 142 along a width direction thereof. The screw block 145 is threaded to the screw shaft 146.

In addition, a forward/reverse motor 147 is mounted at one side of the cutting frame 141.

The forward/reverse motor 147 rotates the screw shaft 146. At this time, the forward/reverse motor 147 may be a screw motor which can control a rotation speed and a rotating direction of the screw shaft 146.

In addition, a wheel motor 149 is mounted on the forward/reverse plate 144 through a mounting bracket 148.

The cutting wheel CW for cutting the shaped beam 40 is mounted at a rotating shaft of the wheel motor 149.

The cutting means 140 moves in keeping pace with the forming speed of the shaped beam 40 on the synchronizing table 112. The forward/reverse motor 147 moves the cutting wheel CW forward or backward so as to cut one side of the shaped beam 40.

In addition, the bending means 150 is mounted at the other side of the synchronizing table 112.

Referring to FIG. 4, a tool holder 153 is fixedly mounted on the other side of the synchronizing table 112.

A stretch bending tool 151 is mounted at the tool holder 153, and a forming surface F2 having a predetermined curvature is formed at a front surface of the stretch bending tool 151.

In a state that the position conversion cylinder 132 changes a position of the shaped beam 40 clamped by both clamping means 120 to the bending position, the bending cylinder 122 of each clamping means 120 moves forward and pushes the shaped beam 40 to the stretch bending tool 151. Then, shaped beam 40 is stretch-bent to have the predetermined curvature corresponding to the forming surface F2 of the stretch bending tool 151.

Hereinafter, a roll forming method by using the roll forming system according to an exemplary embodiment of the present invention will be described in detail with reference to FIG. 3.

Referring to FIG. 3, the uncoiler 1 disposed at the front portion of the process line performs an uncoil step S1 at which the coil 10 is uncoiled.

After performing the uncoil step S1, a straightening step S2 at which the coil 10 uncoiled from the uncoil step S1 is straightened to the panel 20 by using the straightener 2 disposed at the rear of the uncoiler 1 is performed.

A piercing step S3 at which a plurality of holes for assembling the shaped beam is formed at the panel 20 delivered from the straightening step S2 by using the brake press 3 disposed at the rear of the straightener 2 is performed.

After that, a roll forming step S4 at which the panel 20 delivered from the piercing step S3 is sequentially bent to form the shaped beam 30 having the closed section by using the roll forming unit 4 disposed at the rear of the brake press 3 is performed.

A welding step S5 at which each welding position of the shaped beam 30 is welded by using the welding unit 5 disposed at the rear of the roll forming unit 4 is performed.

At this time, the welding step S50 is performed by irradiating the laser beam output from the laser oscillator 5*d* to the welding position of the shaped beam 30 through the laser scanner 5*c*.

After that, a cutting and bending step S6 is performed. At the cutting and bending step S6, a cutting step and a stretch bending step of the shaped beam 40 are sequentially performed after both sides of the shaped beam 40 moving along the process line are clamped. The cutting and bending step S6 is performed in keeping pace with the forming speed of the shaped beam 40.

Firstly, the both sides of the shaped beam 40 which finishes the welding process by the welding unit 5 and moves along the process line are clamped and the one side of the shaped beam 40 is cut.

After that, the shaped beam 40 is moved toward the stretch bending tool 151.

Finally, the shaped beam 40 is pushed to the forming surface F2 of the stretch bending tool 151 and the shaped beam having the predetermined curvature is formed.

An operation of the bending unit 6 performing the cutting and bending step S5 will be described in detail with reference to FIG. 9 to FIG. 14.

Figure 9:
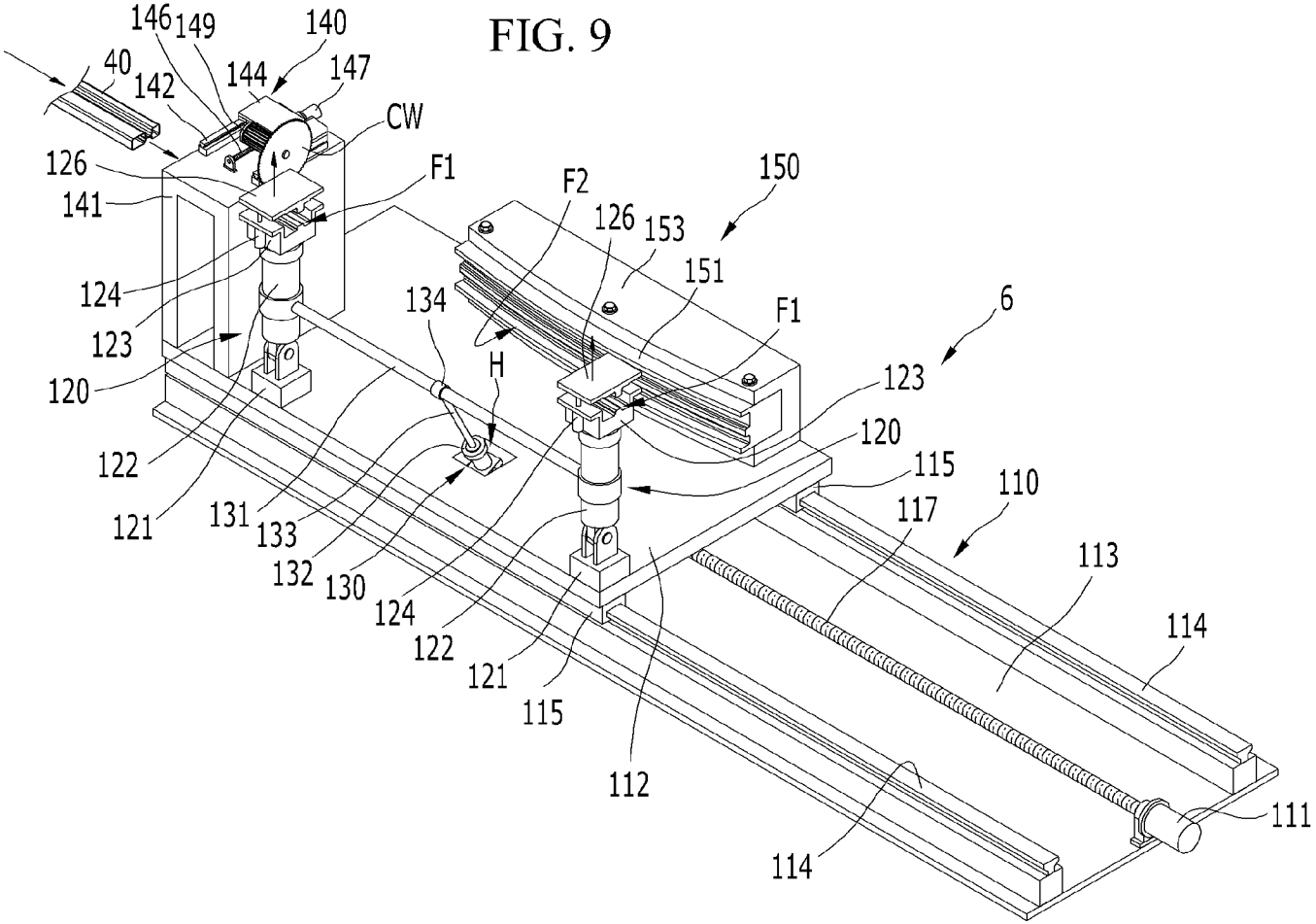
FIG. 9 to FIG. 14 shows processes performed by a bending unit used in a roll forming system according to an exemplary embodiment of the present invention.

Referring to FIG. 9, the shaped beam 40 which was roll-formed by the roll forming unit 4 and was welded by the welding unit 5 is delivered to the bending unit 6.

At this time, the synchronizing table 112 is positioned at a front portion of the rail plate 113 by an operation of the synchronizing motor 111, and the forward/reverse motor 147 stays the cutting wheel CW at the rear position.

In addition, the position conversion cylinder 132 moves forward such that the both bending cylinders 122 are erected in a vertical direction, and the both clamping cylinders 124 moves forward such that the both locators 123 are released with respect to each clamper 126.

Figure 10:
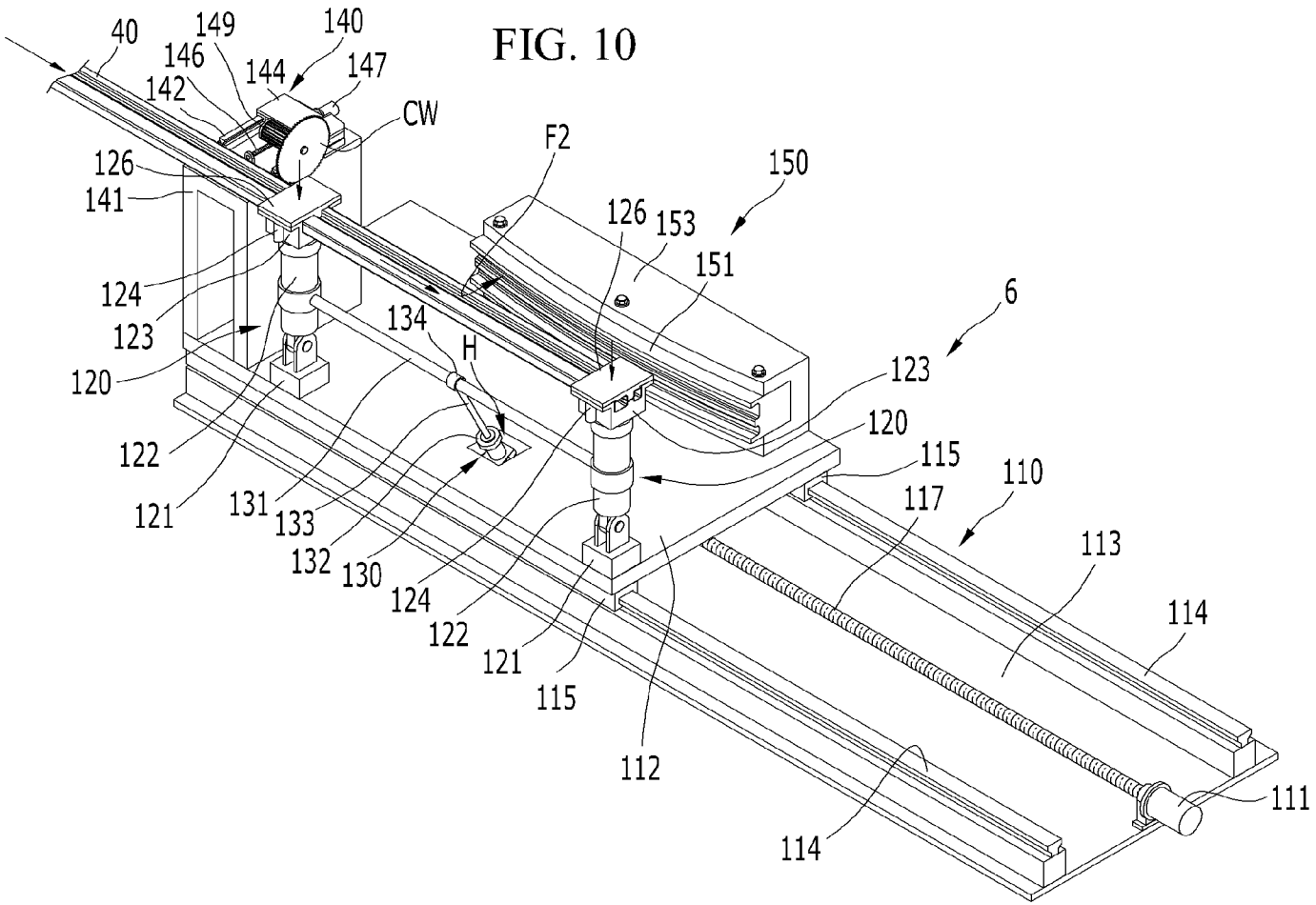

At this state, the shaped beam 40, as shown in FIG. 10, moves with the forming speed and the both sides of the shaped beam 40 are inserted respectively in the receiving surfaces F1 of both locators 123. At this time, each clamping cylinder 124 moves backward and the both sides of the shaped beam 40 on the locator 123 are clamped by the clampers 126.

Simultaneously, the synchronizing motor 111 is operated such that the synchronizing table 112 moves with the same speed as the forming speed along the process line on the rail plate 113.

Figure 11:
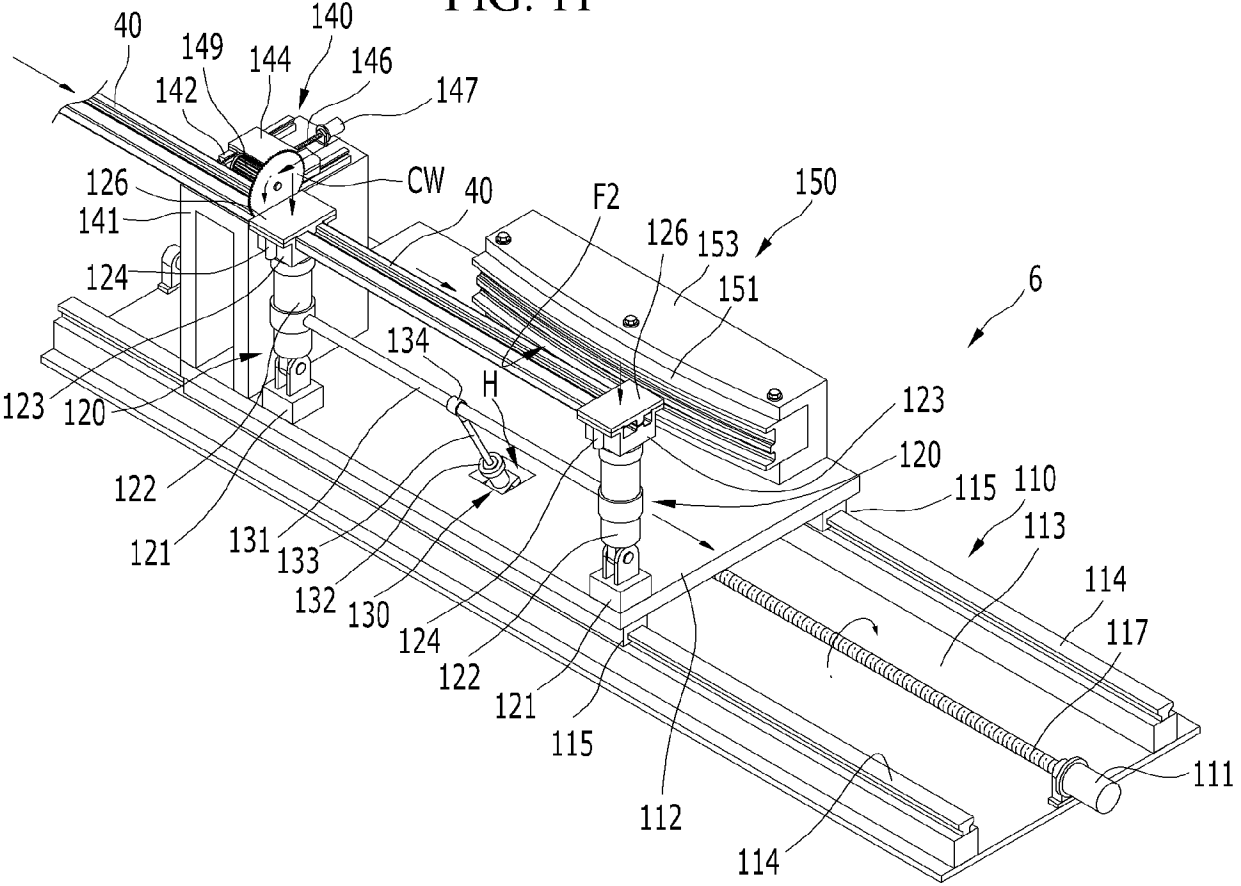

After that, as shown in FIG. 11, the wheel motor 149 rotates the cutting wheel CW, and the forward/reverse motor 147 moves the cutting wheel CW as well as the forward/reverse plate 144 forward to the shaped beam 40.

At this time, in a state that the shaped beam 40 is clamped by the locators 123 and the clampers 126, the shaped beam 40 and the cutting wheel CW move along the process line and the one side of the shaped beam 40 is cut by the cutting wheel CW.

Figure 12:
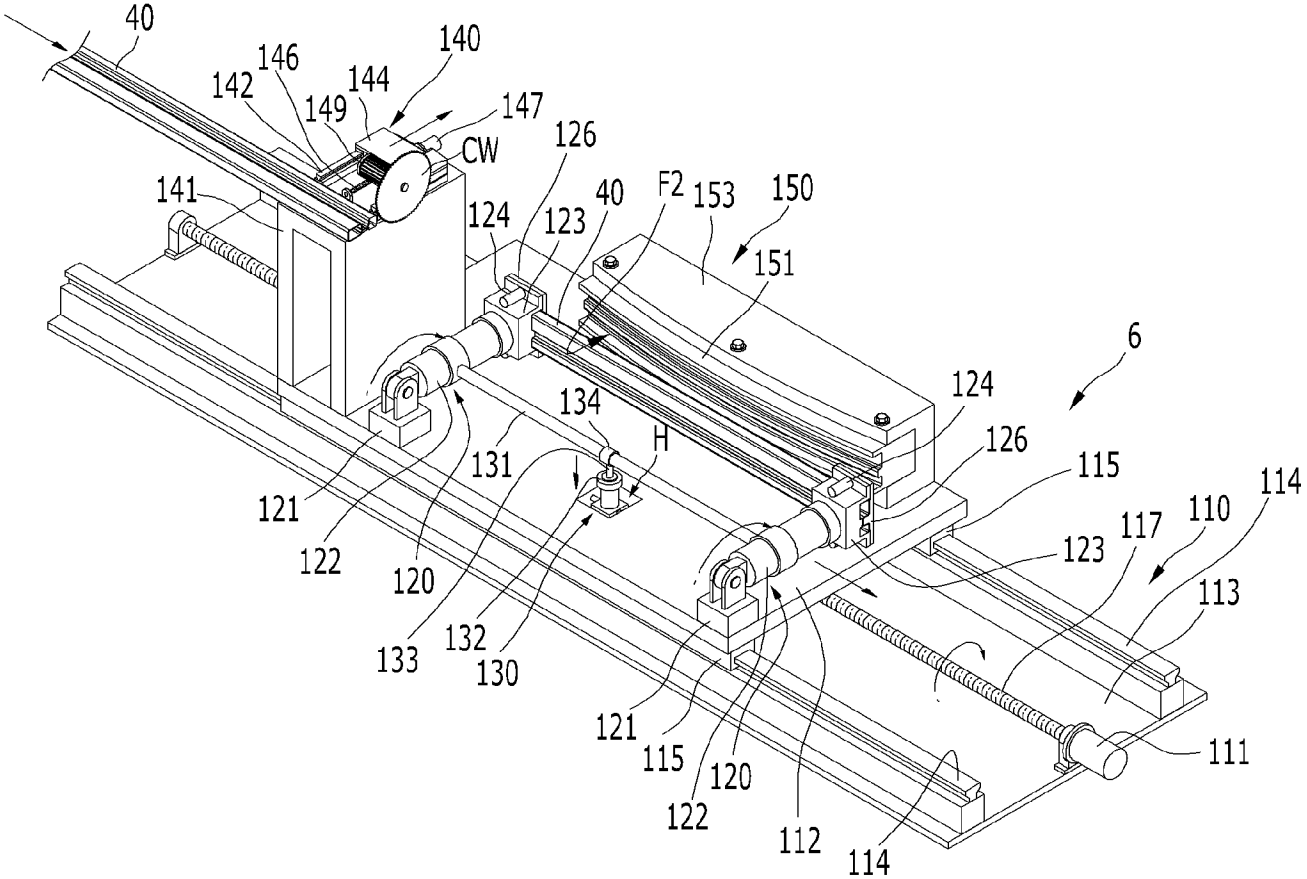

After that, as shown in FIG. 12, in a state that the synchronizing table 112 moves with the forming speed, the shaped beam 40, the one side of which is cut by the cutting wheel CW, changes its position by the operation of the position conversion cylinder 132.

That is, if the position conversion cylinder 132 moves backward and the connecting rod 131 connected thereto pulls the bending cylinder 122 downward, the position of the shaped beam 40 clamped by the locators 123 and the clampers 126 is changed from the cutting position to the bending position corresponding to the forming surface F2 of the stretch bending tool 151.

At this time, the cutting wheel CW together with the forward/reverse plate 144 moves backward and returns to its original position by the operation of the forward/reverse motor 147.

Figure 13:
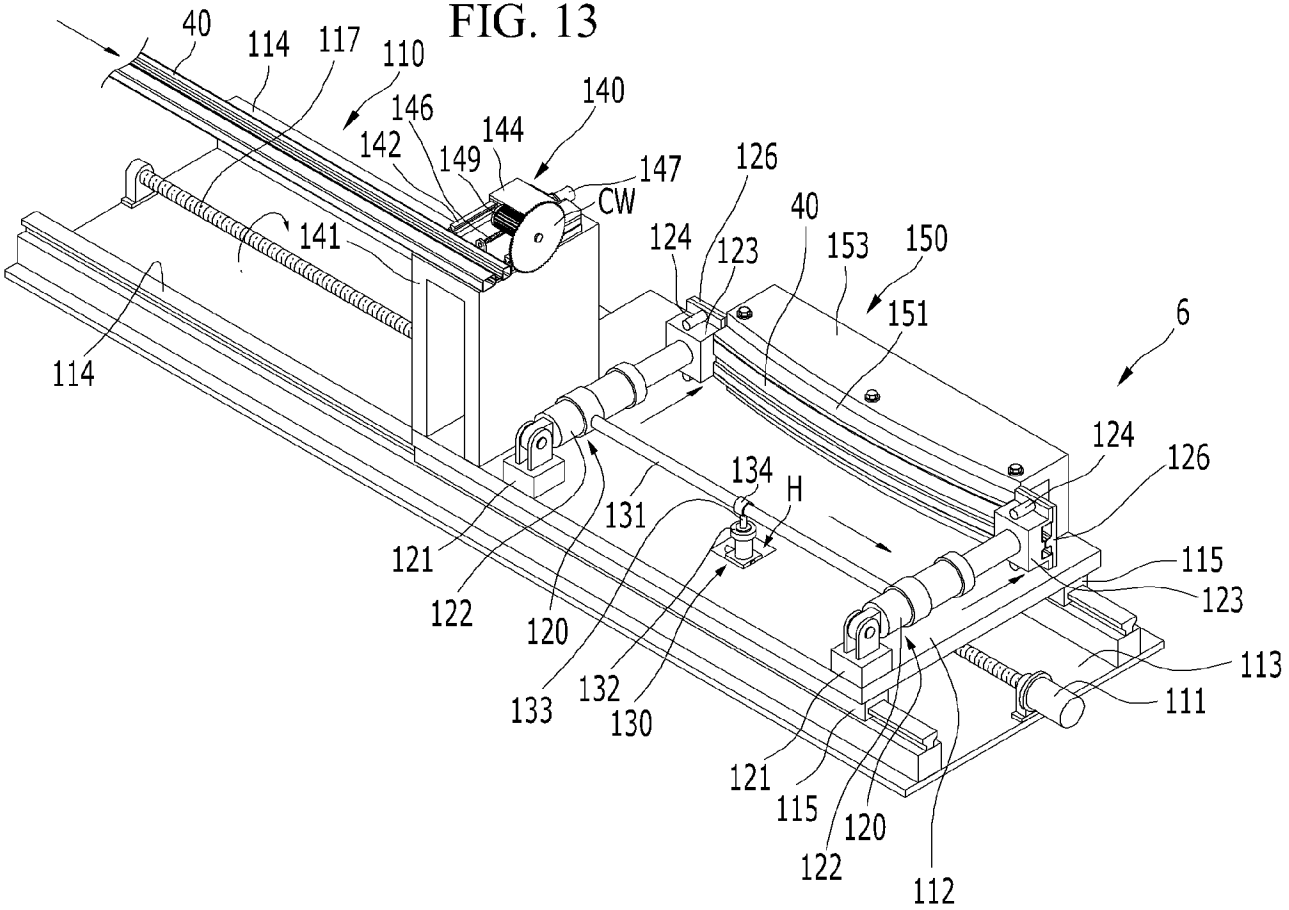

After that, as shown in FIG. 13, in a state that the shaped beam 40 is positioned at the bending position, the bending cylinders 122 move forward and pushes the shaped beam 40 to the forming surface F2 of the stretch bending tool 151. Therefore, the shaped beam 40 is stretch-bent to have the predetermined curvature.

The cutting and bending processes of the shaped beam 40 are performed on the synchronizing table 112 which moves with the forming speed along the guide rails 114 of the rail plate 113.

Figure 14:
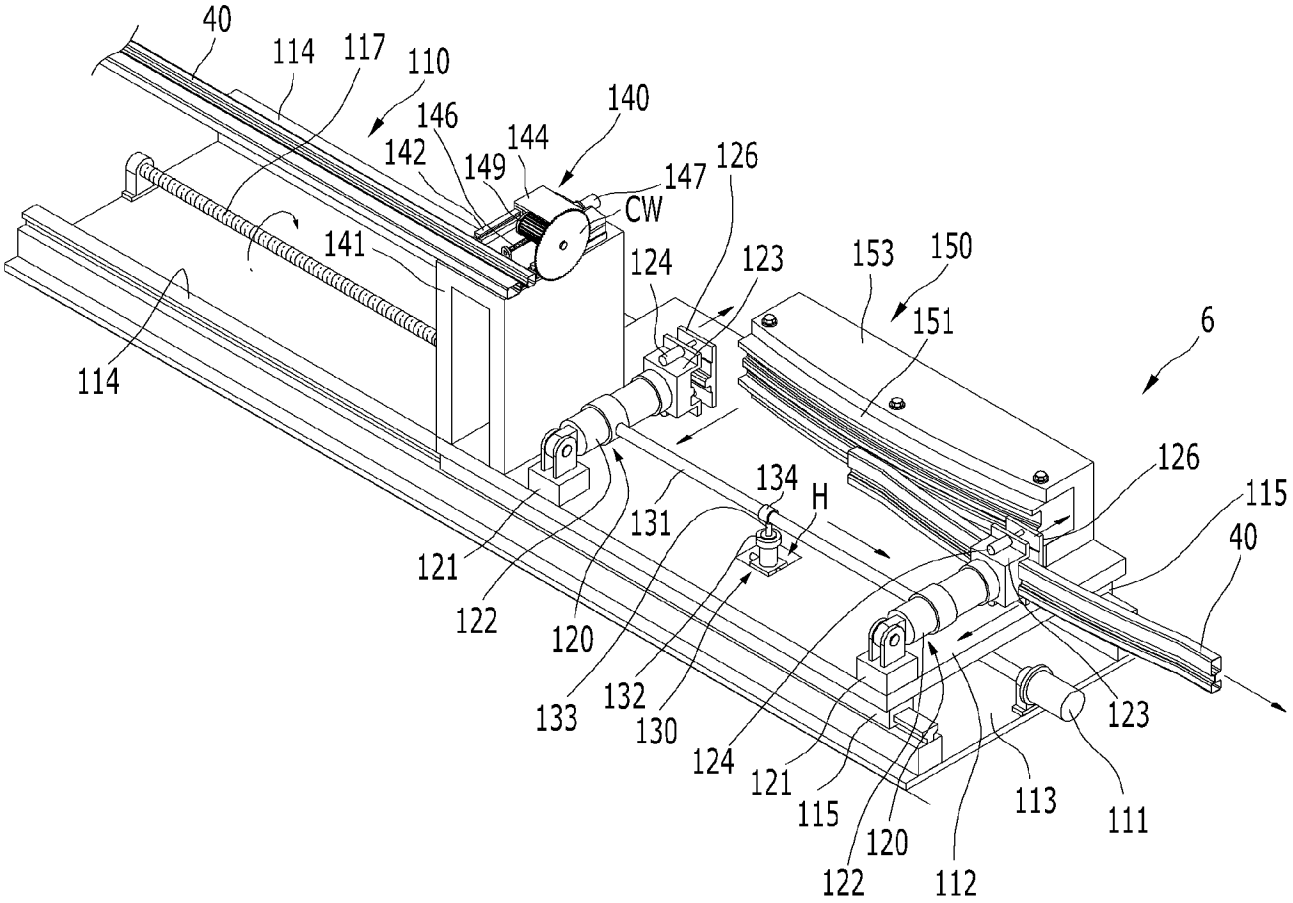

After that, as shown in FIG. 14, the bending cylinder 122 moves backward and the clamping cylinder 124 moves forward. Therefore, the shaped beam 40 finishing stretch bending is taken out.

After that, the position conversion cylinder 132 moves forward so as to return the bending cylinder 122 to its original position, and the synchronizing motor 111 rotates at a high speed so as to return the synchronizing table 112 toward the welding unit 5.

When the synchronizing table 112 is returned, the shaped beam 40 moving along the process line is inserted in the locators 123 and the clampers 126. Therefore, a following cutting and bending step can proceed.

According to an exemplary embodiment of the present invention, cutting and stretch bending of a shaped beam is sequentially performed in keeping pace with a forming speed of a roll forming after the roll forming.

Accordingly, the shaped beam of closed section having thickness thicker than 50 mm can be bent so as to have a target curvature in a roll forming process.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A roll forming system comprising:

an uncoiler disposed at a front portion of a process line and uncoiling a coil;

a straightener disposed at the rear of the uncoiler and straightening the coil uncoiled by the uncoiler to a panel of plate shape;

a brake press disposed at the rear of the straightener and forming a plurality of holes for assembling at the panel delivered from the straightener;

a roll forming unit disposed at the rear of the brake press and sequentially bending the panel delivered from the brake press so as to roll-form a shaped beam of a predetermined shape; and a welding unit disposed at the rear of the roll forming unit and welding each welding position of the shaped beam which is roll-formed, wherein the roll forming system further comprises a bending unit disposed at the rear of the welding unit, cutting one side of the shaped beam by a cutting wheel, changing a position of the shaped beam, and pushing the shaped beam to a stretch bending tool so as to bend the shaped beam to have a predetermined curvature in keeping pace with a forming speed of a roll forming in a state that both sides of the shaped beam delivered from the welding unit are clamped, wherein the bending unit comprises:

synchronizing means disposed at the rear of the welding unit and provided with a synchronizing table which can slide along the process line by an operation of a synchronizing motor;

clamping means mounted on front and rear portions of the synchronizing table, rotating along a width direction of the synchronizing table, and clamping the both sides of the roll-formed shaped beam;

position conversion means pivotably mounted on the synchronizing table between the both clamping means, connected to the both clamping means, and configured to convert a position of the shaped beam clamped by the both clamping means between a cutting position and a bending position;

cutting means mounted on the synchronizing table through a cutting frame, moving with the synchronizing table in keeping pace with the forming speed of the shaped beam, and cutting the one side of the shaped beam by moving the cutting wheel forward or backward by a forward/reverse motor; and bending means disposed on the synchronizing table and bending the shaped beam to have the predetermined curvature by a force of the clamping means in a state that the position of the shaped beam clamped by the clamping means is changed to the bending position by the position conversion means.

2. The roll forming system of claim 1, wherein the welding unit comprises:

front and rear guide rollers mounted apart from each other at the rear of the roll forming unit and guiding a movement of the shaped beam; and a laser scanner disposed between and above the front and rear guide rollers and irradiating a laser beam output from a laser oscillator to the welding position of the shaped beam so as to perform a welding process.

3. The roll forming system of claim 1, wherein the synchronizing means comprise:

a rail plate provided with guide rails mounted on both side portions thereof along the process line;

a synchronizing table slidably mounted at each guide rail through a rail block and provided with a screw block mounted on a lower surface thereof; and a synchronizing motor provided with a screw shaft mounted on the rail plate along the process line, threaded to the screw block, and configured to move the synchronizing table along the process line by rotating the screw shaft.

4. The roll forming system of claim 3, wherein the synchronizing motor is a screw motor which can control a rotation speed and a rotating direction.

5. The roll forming system of claim 1, wherein the clamping means comprise:

hinge blocks mounted on front and rear portions of the synchronizing table;

a bending cylinder mounted on an upper end of each hinge block and rotating along a width direction of a synchronizing table;

a locator mounted at an operating rod of each bending cylinder and provided with a receiving surface of the shaped beam formed at an upper end thereof;

clamping cylinders fixedly mounted respectively at flange portions formed at both sides of the locator; and a clamper disposed corresponding to the receiving surface of the locator and provided with both sides connected to operating rods of the clamping cylinders.

6. The roll forming system of claim 5, wherein the bending cylinder is a hydraulic pressure cylinder operated by hydraulic pressure.

7. The roll forming system of claim 1, wherein the position conversion means comprise:

a connecting rod connecting the both clamping means; and a position conversion cylinder pivotably connected to a mounting hole formed on the synchronizing table, connected to the connecting rod through a rotation ring, and configured to push or pull the connecting rod.

8. The roll forming system of claim 7, wherein the position conversion cylinder is a hydraulic pressure cylinder operated by hydraulic pressure.

9. The roll forming system of claim 1, wherein the cutting means comprise:

a cutting frame mounted on the synchronizing table and provided with forward/reverse rails formed on front and rear portions of an upper surface along a width direction thereof;

a forward/reverse plate slidably mounted on the forward/reverse rails through sliders and provided with a screw block formed on a lower surface thereof;

the forward/reverse motor disposed on the cutting frame along a width direction thereof, provided with a screw shaft threaded to the screw block, and moving the forward/reverse plate by rotating the screw shaft; and a wheel motor mounted to the forward/reverse plate through a mounting bracket and rotating the cutting wheel.

10. The roll forming system of claim 9, wherein the forward/reverse motor is a screw motor which can control a rotation speed and a rotating direction.

11. The roll forming system of claim 1, wherein the bending means comprise:

a tool holder fixed on the synchronizing table; and the stretch bending tool mounted at the tool holder and provided with a forming surface having a predetermined curvature formed at one surface thereof.

* * * * *